US011643244B2

(12) United States Patent
Valencia et al.

(10) Patent No.: US 11,643,244 B2
(45) Date of Patent: May 9, 2023

(54) FLAT PACK TRAY WITH CURVE ON SET-UP AND BLANK FOR FORMING THE SAME

(71) Applicant: WESTROCK SHARED SERVICES, LLC, Atlanta, GA (US)

(72) Inventors: John Valencia, Johns Creek, GA (US); Abagail L. Bleakney, Atlanta, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 311 days.

(21) Appl. No.: 16/957,205

(22) PCT Filed: Dec. 21, 2018

(86) PCT No.: PCT/US2018/067015
§ 371 (c)(1),
(2) Date: Jun. 23, 2020

(87) PCT Pub. No.: WO2019/135942
PCT Pub. Date: Jul. 11, 2019

(65) Prior Publication Data

US 2020/0391902 A1 Dec. 17, 2020

Related U.S. Application Data

(60) Provisional application No. 62/687,464, filed on Jun. 20, 2018, provisional application No. 62/613,097, filed on Jan. 3, 2018.

(51) Int. Cl.
*B65D 5/50* (2006.01)
*A47G 23/02* (2006.01)
(Continued)

(52) U.S. Cl.
CPC ..... *B65D 5/5038* (2013.01); *A47G 23/0241* (2013.01); *B31B 50/26* (2017.08);
(Continued)

(58) Field of Classification Search
CPC ..... B65D 5/5021; B65D 2571/0066; B65D 2571/00308; B65D 2571/00716;
(Continued)

(56) References Cited

U.S. PATENT DOCUMENTS 2,303,264 A 11/1942 Flick
2,522,325 A 9/1950 Williamson
(Continued)

*Primary Examiner* — Christopher R Demeree
(74) *Attorney, Agent, or Firm* — Brian J. Goldberg

(57) ABSTRACT

A tray formed from a blank of sheet material includes a bottom panel, a top panel, first and second side panels, and a locking band connected to the bottom panel at opposite upper and lower edges thereof. The locking band extends across the top panel and holds an underlying portion of the top panel in face-contacting relationship with the bottom panel. The tray is configured to transition from a first, substantially flat configuration into a second, erect configuration in which the top panel defines a concave surface configured to hold in place a rounded item. The tray is
(Continued)

configured to be transitioned from the first configuration to the second configuration by sliding the top panel relative to the bottom panel.

20 Claims, 14 Drawing Sheets

(51) Int. Cl.
*B31B 50/62* (2017.01)
*B31B 50/73* (2017.01)
*B31B 50/26* (2017.01)
*B31B 120/30* (2017.01)

(52) U.S. Cl.
CPC ..... *B31B 50/624* (2017.08); *B31B 50/734* (2017.08); *B31B 2120/302* (2017.08)

(58) Field of Classification Search
CPC ..... B65D 2571/00296; B65D 71/16; B65D 5/5038; A47G 23/0241; B31B 50/26; B31B 50/734; B31B 50/624
USPC ..... 206/557, 485, 426, 434, 446; 229/120.15, 167, 168, 173
See application file for complete search history.

(56) References Cited

U.S. PATENT DOCUMENTS

| | | | | |
|---|---|---|---|---|
| 2,705,589 | A | 4/1955 | Steele | |
| 3,036,754 | A * | 5/1962 | Kleingers, Jr. | B65D 5/5016 206/588 |
| 3,250,455 | A * | 5/1966 | Plunkett | B65D 5/2066 206/424 |
| 4,121,752 | A * | 10/1978 | Ravotto | B65D 5/50 206/45.21 |
| 4,448,308 | A * | 5/1984 | Carver | B65D 71/125 206/427 |
| 4,485,922 | A | 12/1984 | Desmond et al. | |
| 5,673,847 | A | 10/1997 | Swink | |
| 6,474,473 | B2 * | 11/2002 | Wong | B65D 5/5021 206/427 |
| D528,411 | S * | 9/2006 | Nehus | D9/432 |
| 8,887,984 | B2 * | 11/2014 | Bahr | B65D 5/5021 229/120.16 |
| 10,894,646 | B2 * | 1/2021 | Simpkins | B65D 5/04 |

* cited by examiner

FLAT PACK TRAY WITH CURVE ON SET-UP AND BLANK FOR FORMING THE SAME

REFERENCE TO RELATED APPLICATION

This application claims the benefit of priority under 35 U.S.C. § 119(e) of U.S. provisional application Ser. No. 62/613,097 filed on Jan. 3, 2018 which is hereby incorporated by reference in its entirety.

BACKGROUND

The field of the invention relates generally to trays and blanks for forming the same.

Due to their tendency to roll, rounded items may present difficulties for, for example, shipping production lines that assemble and pack a variety of items for shipping. Thus, it would be desirable to provide a tray for holding items, including but not limited to rounded or cylindrical items, in place as they move along a production line. It would be desirable to provide a tray that is inexpensive to manufacture. It would also be desirable to provide a tray that can be shipped in a compact, knocked-down-flat configuration and quickly erected on site by hand or machine. It would also be desirable to provide a tray that can accommodate a variety of objects of different sizes, weights, and shapes.

SUMMARY

According to a first aspect of the invention, there is provided a tray formed from a blank of sheet material. The tray includes a bottom panel forming a bottom wall of the tray, a top panel forming a top wall of the tray, first and second side panels forming first and second side walls of the tray and extending between the top and bottom panels on opposite sides thereof, and a locking band connected to the bottom panel at opposite upper and lower edges thereof. The locking band extends across the top panel and holds an underlying portion of the top panel in face-contacting relationship with the bottom panel. The tray is configured to transition from a first configuration in which the tray is substantially flat into a second or erect configuration in which the top panel defines a concave surface configured to hold in place a rounded item. The tray is configured to be transitioned from the first configuration to the second configuration by sliding the top panel relative to the bottom panel.

Optionally, the locking band overlies a generally central portion of the top panel when the tray is in the second configuration.

Optionally, the top panel has a first width and the bottom panel has a second width, and the first width is smaller than the second width.

Optionally, the locking band is formed from overlapping first and second locking arm flaps. The first locking arm flap is hingedly connected to the upper edge of the bottom panel, and the second locking arm flap is hingedly connected to the lower edge of the bottom panel.

Optionally, at least one finger cutout is formed in the top panel.

Optionally, the tray includes a first finger cutout formed along a first side edge of the top panel and a second finger cutout formed along a second opposite side edge of the top panel.

Optionally, a plurality of strengthening creases are formed in the first and second side panels.

Optionally, the top panel includes a top center panel hingedly connected to a first top side panel and a second top side panel.

Optionally, the locking band comprises first and second locking tabs configured to be received within respective first and second locking apertures formed in the top panel so as to resist collapsing of the tray when the tray is in the second configuration.

According to a second aspect of the invention, there is provided a blank of sheet material for forming a tray. The blank includes a plurality of panels hingedly connected in series. The plurality of panels include a top panel configured to form a top wall in a set-up tray, a first side panel configured to form a first side wall in the set-up tray, a bottom panel configured to form a bottom wall in the set-up tray, and a second side panel configured to form a second side wall in the set-up tray. The tray also includes a first locking arm flap hingedly connected to the bottom panel along an upper edge thereof and a second locking arm flap hingedly connected to the bottom panel along a lower edge thereof. The first and second locking arm flaps are configured to be secured together to form a locking band in the set-up tray. The locking band extends across the top panel and holds an underlying portion of the top panel in face-contacting relationship with the bottom panel. The set-up tray is configured to transition from a first configuration in which the set-up tray is substantially flat, into a second or erect configuration in which the top wall defines a concave surface configured to hold in place a curved item. The set-up tray is configured to be transitioned from the first configuration to the second configuration by sliding the top panel relative to the bottom panel.

Optionally, the plurality of panels includes a glue flap panel configured to be secured in face-contacting relationship to the second side panel in the set-up tray.

Optionally, the locking band overlies a generally central portion of the top panel when the tray is in the second configuration.

Optionally, the top panel has a first width and the bottom panel has a second width, and the first width is smaller than the second width.

Optionally, at least one finger cutout is formed in the top panel.

Optionally, the blank includes a first finger cutout formed along a first side edge of the top panel and a second finger cutout formed along a second opposite side edge of the top panel.

Optionally, a plurality of strengthening creases are formed in the first and second side panels.

Optionally, the top panel includes a top center panel hingedly connected to a first top side panel and a second top side panel.

Optionally, the locking band includes first and second locking tabs configured to be received within respective first and second locking apertures formed in the top panel so as to resist collapsing of the set-up tray when the set-up tray is in the second configuration.

BRIEF DESCRIPTION OF THE DRAWINGS

Exemplary embodiments of the invention will now be described with reference to the accompanying drawings, in which.

DETAILED DESCRIPTION

Detailed descriptions of specific embodiments of trays and blanks are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the trays and blanks described herein may be embodied in various and alternative forms. The Figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
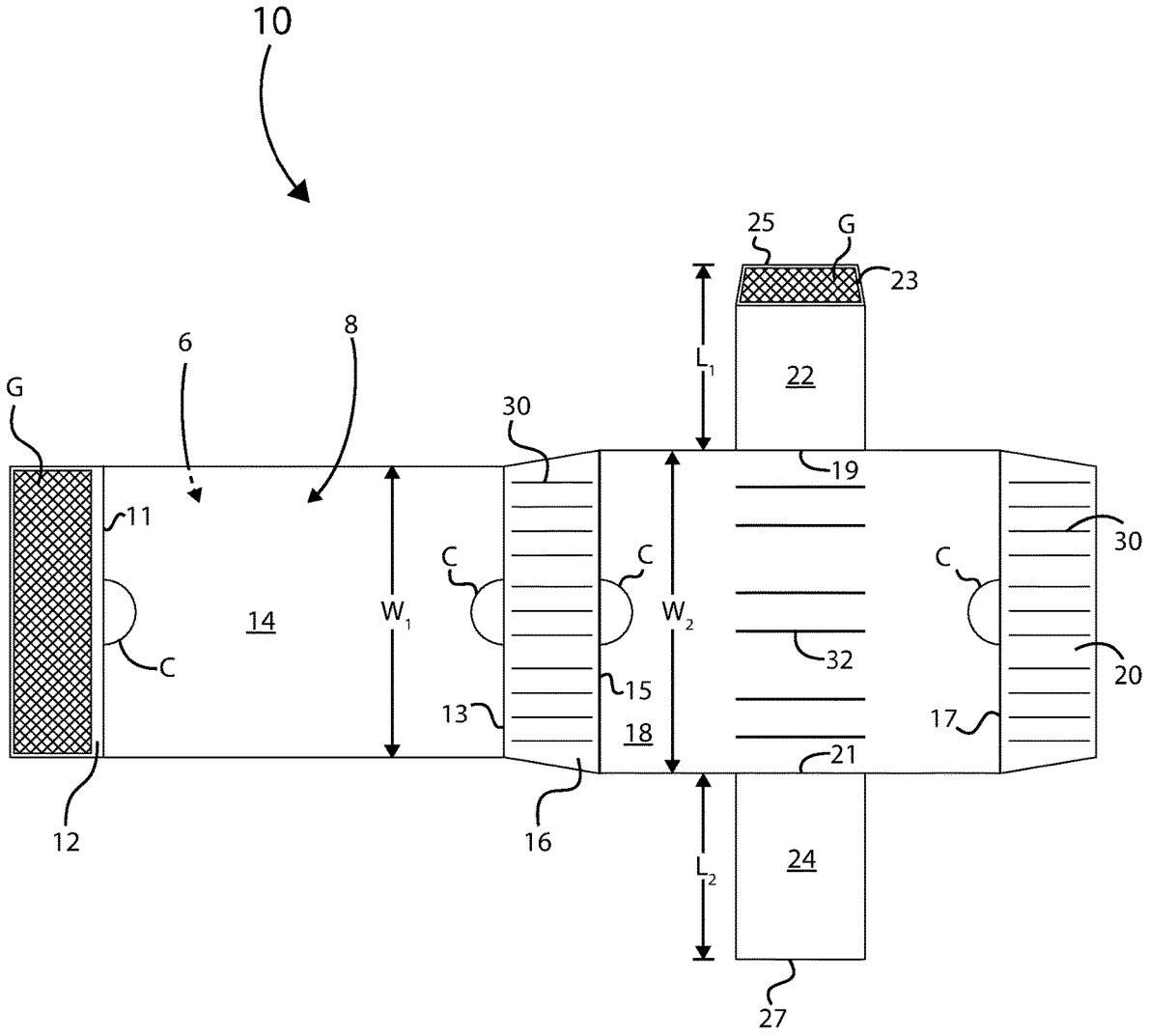
FIG. 1 is a top plan view of an exemplary blank of sheet material according to a first embodiment of the invention.
Figure 2:
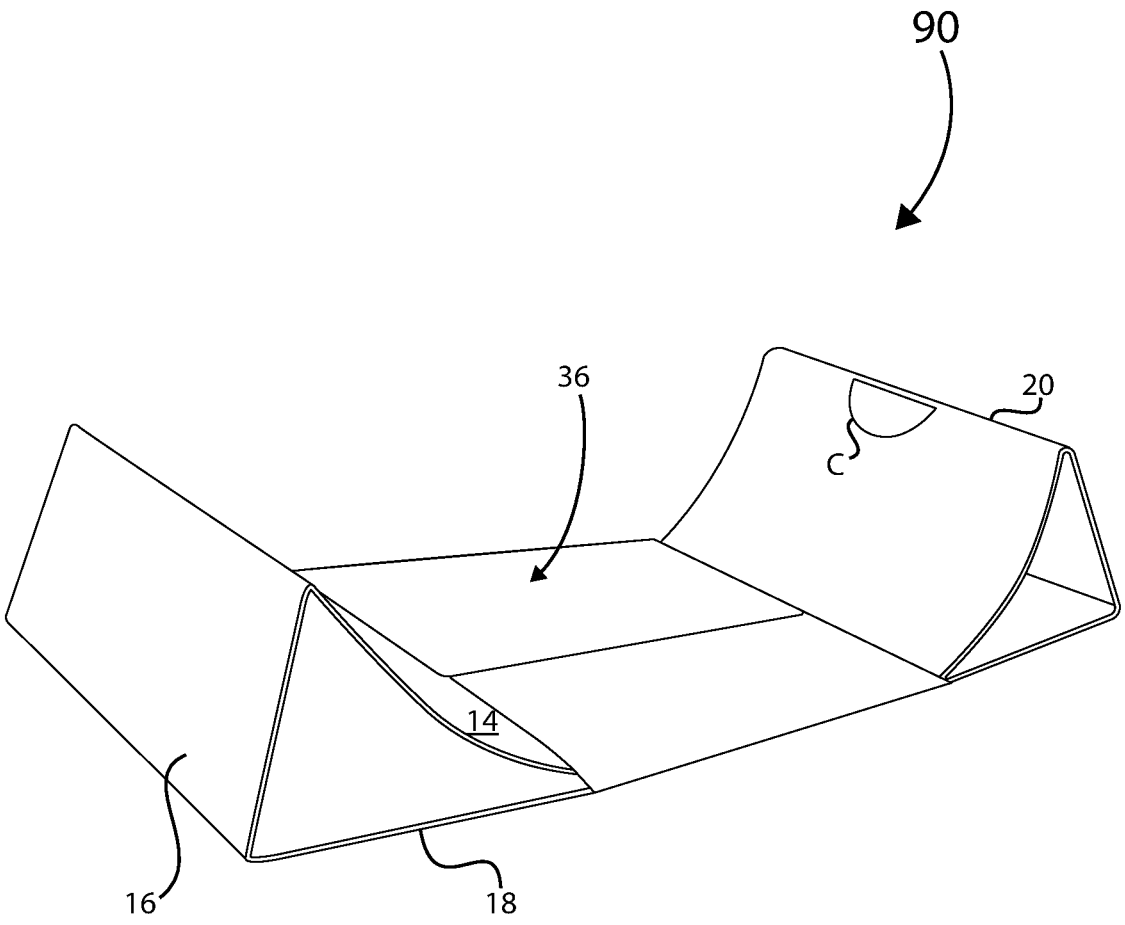
FIG. 2 is a perspective view of a tray formed from the blank shown in FIG. 1.
Figure 3:
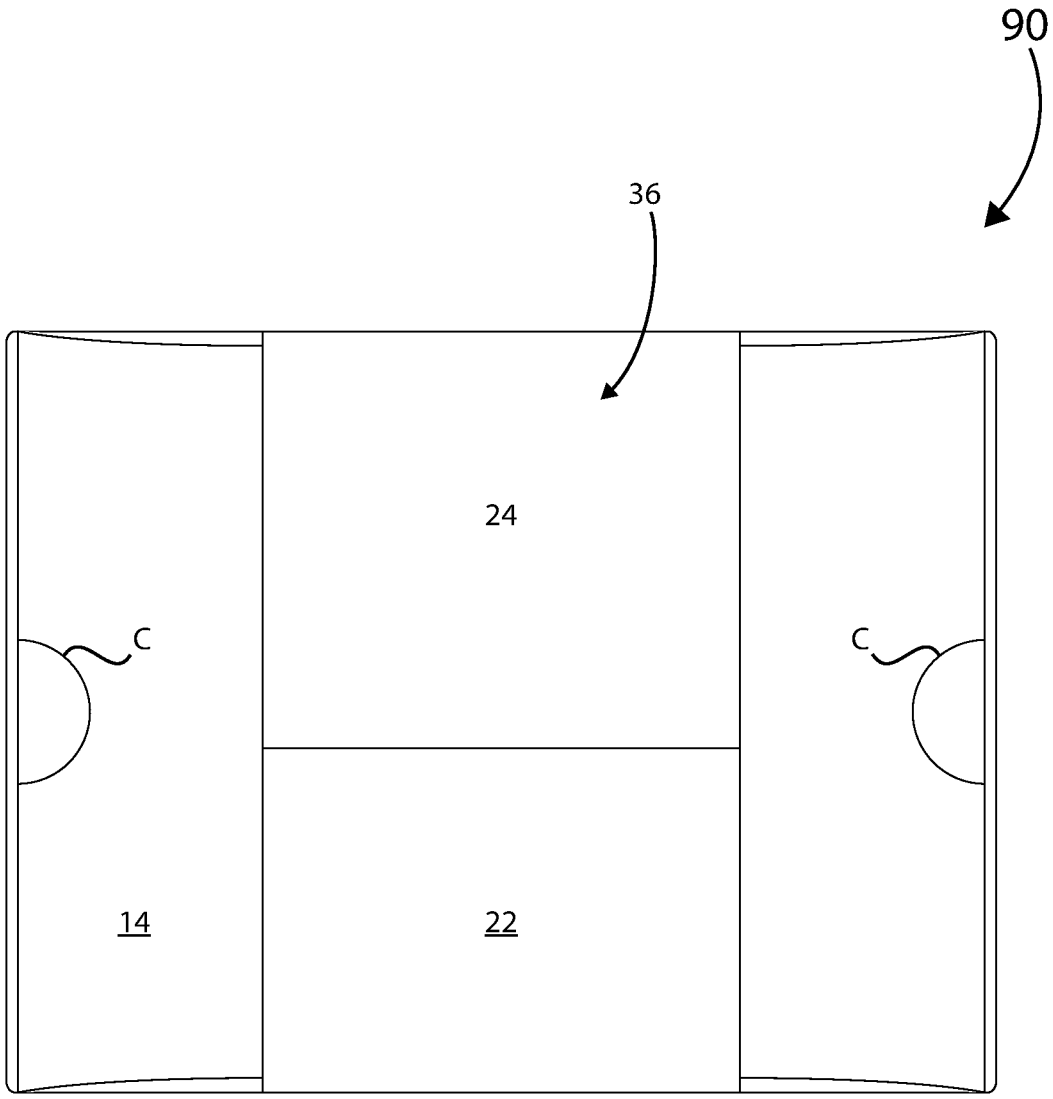
FIG. 3 is a top view of the tray of FIG. 2.
Figure 4:
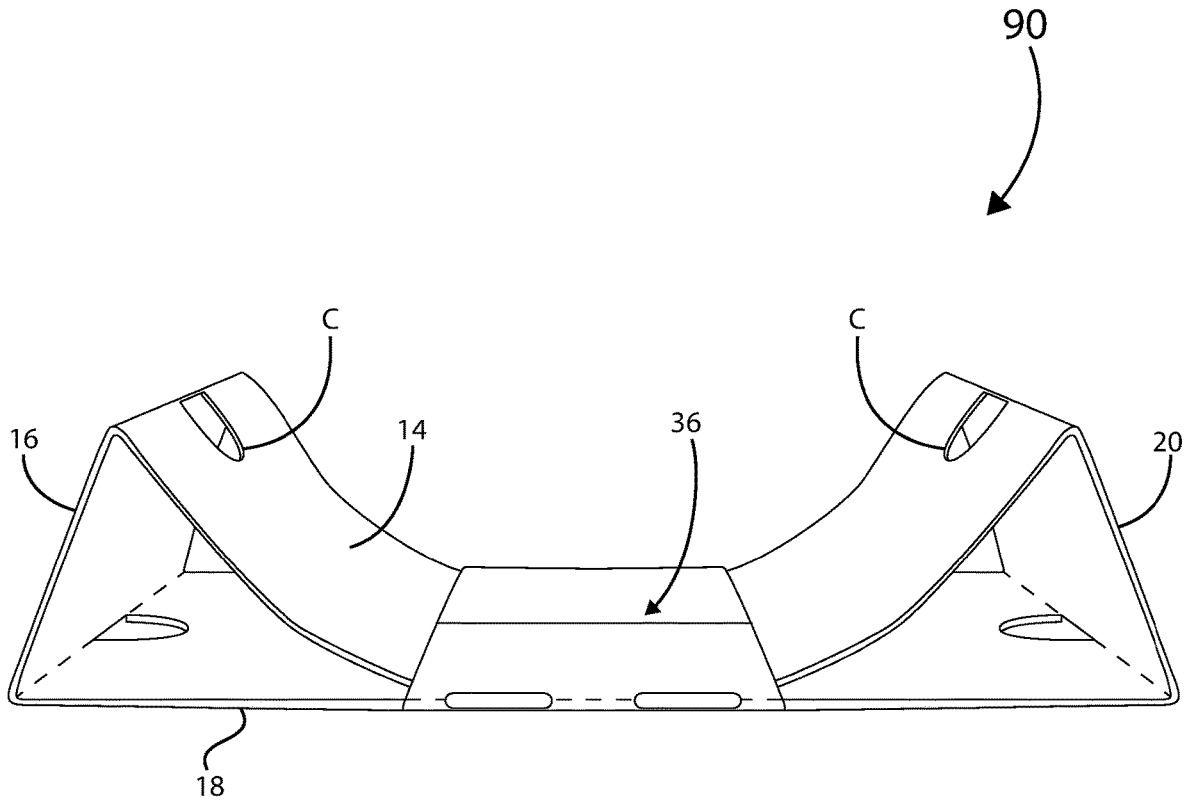
FIG. 4 is a end view of the tray of FIG. 2.
Figure 5:
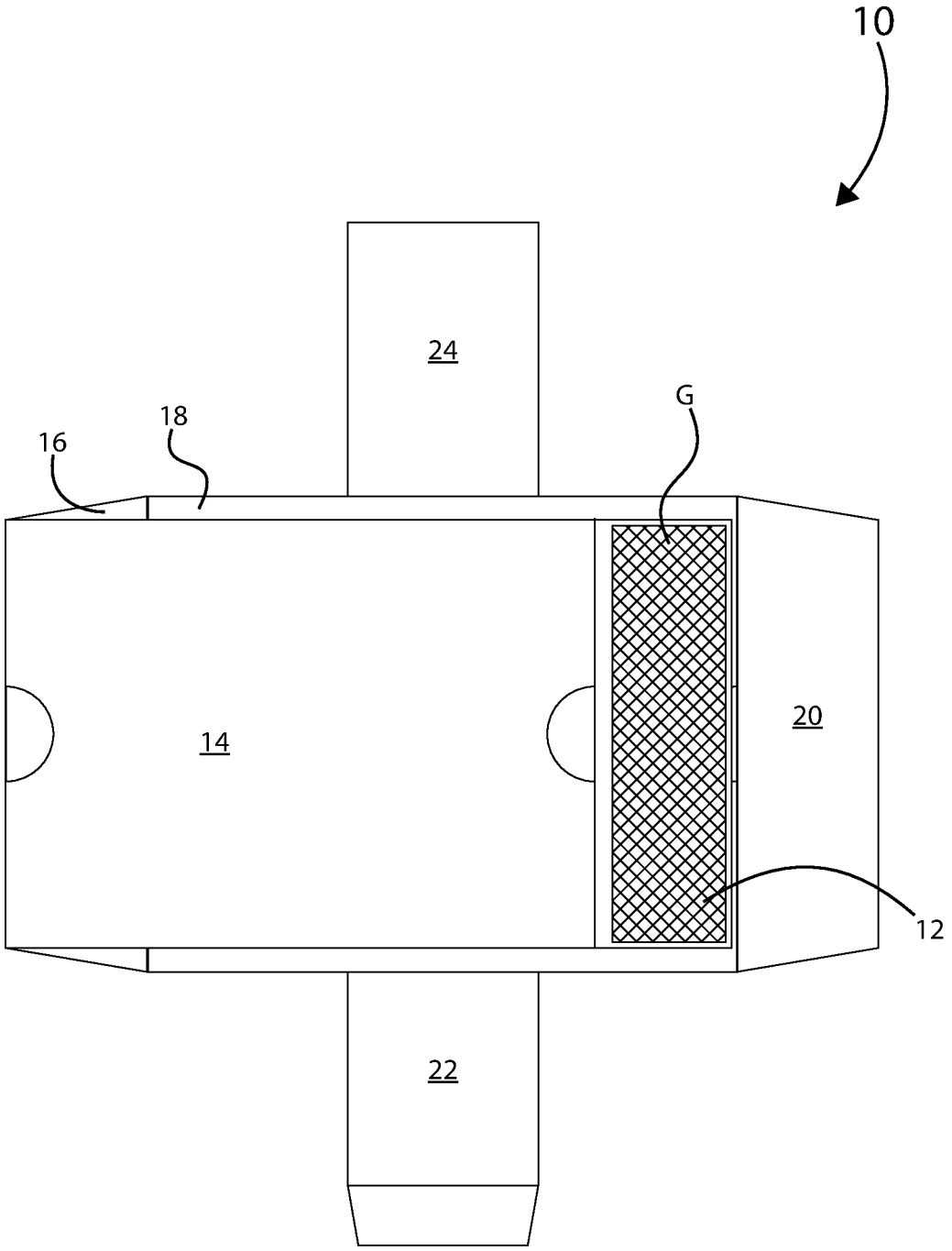
FIG. 5 shows an intermediate step in the construction of the tray of FIG. 2.

Referring to FIG. 1, there is shown a first blank 10 for forming a tray 90 (see FIGS. 2-4). The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, for example, to provide the trays described in more detail below.

Referring to FIG. 1, blank 10 is generally rectangular in shape and has a first or interior surface 6 and a second or exterior surface 8. Blank 10 is generally symmetrical about a central longitudinal axis. In a set-up condition, the tray 90 forms a structure having a bottom wall 92, concave top wall 94, and first and second side walls 96, 98.

Blank 10 includes a plurality of panels hingedly connected together in series. Glue flap panel 12 is hingedly connected to a bottom panel 14 via transverse fold line 11. Top panel 14 is hingedly connected to a first side panel 16 via transverse fold line 13. First side panel 16 is hingedly connected to a bottom panel 18 via transverse fold line 15. Bottom panel 18 is hingedly connected to a second side panel 20 via transverse fold line 17. Glue flap panel 12, top panel 14, first side panel 16, bottom panel 18, and second side panel 20 may each be generally rectangular in shape. In the illustrated embodiment, first side panel 14 and second side panel 20 are mirror images of one another and generally trapezoidal in shape. In the illustrated embodiment, top panel 14 has a width W1 that is slightly less than a width W2 of bottom panel 18. Cutouts C that serve as finger holes are formed in opposite ends of the top panel 14 along fold lines 11 and 33, and in opposite ends of the bottom panel 18 along fold lines 15 and 17. In the illustrated embodiments, cutouts C are semi-circular in shape although other shapes can be used A first locking arm flap 22 is hingedly connected to an upper edge of bottom panel 18 via longitudinal fold line 19. A second locking arm flap 24 is hingedly connected to a lower edge of bottom panel 18 via longitudinal fold line 21. In the illustrated embodiment, first and second locking arm flaps 22, 24 are generally rectangular in shape. In the illustrated embodiment, an outermost portion 23 of first locking arm flap 22 is slightly tapered. Outermost portion 23 may be used as a glue-receiving portion. First locking arm flap 22 has a length L1 measured between fold line 19 and an outermost edge 25 of first locking arm flap 22. Second locking arm flap 24 has a length L2 measured between fold line 21 and an outermost edge 27 of second locking arm flap 24. Lengths L1 and L2 may be equal or substantially equal to one another. First and second locking arm flaps 22, 24 are configured such that their combined length (L1+L2) is greater than the width W2 of bottom flap 18 so as to allow the glue-receiving portion 23 of first locking arm flap 22 to overlap with an outermost portion of second locking arm flap 24 when the tray 90 is constructed.

A plurality of parallel creases and/or engraved lines 30 running perpendicular to the grain of the blank 10 may be formed in the first and second side walls 16, 20. Similarly a plurality of parallel creases and/or engraved lines 32 may be formed in bottom panel 18. Creases 30, 32 may provide better strength and prevent unwanted creasing under load.

Turning to the construction of the tray 90 as illustrated in FIG. 2, the tray 90 can be formed by a series of sequential folding operations. The folding process is not limited to that described below and may be altered according to particular manufacturing requirements.

Figure 6:
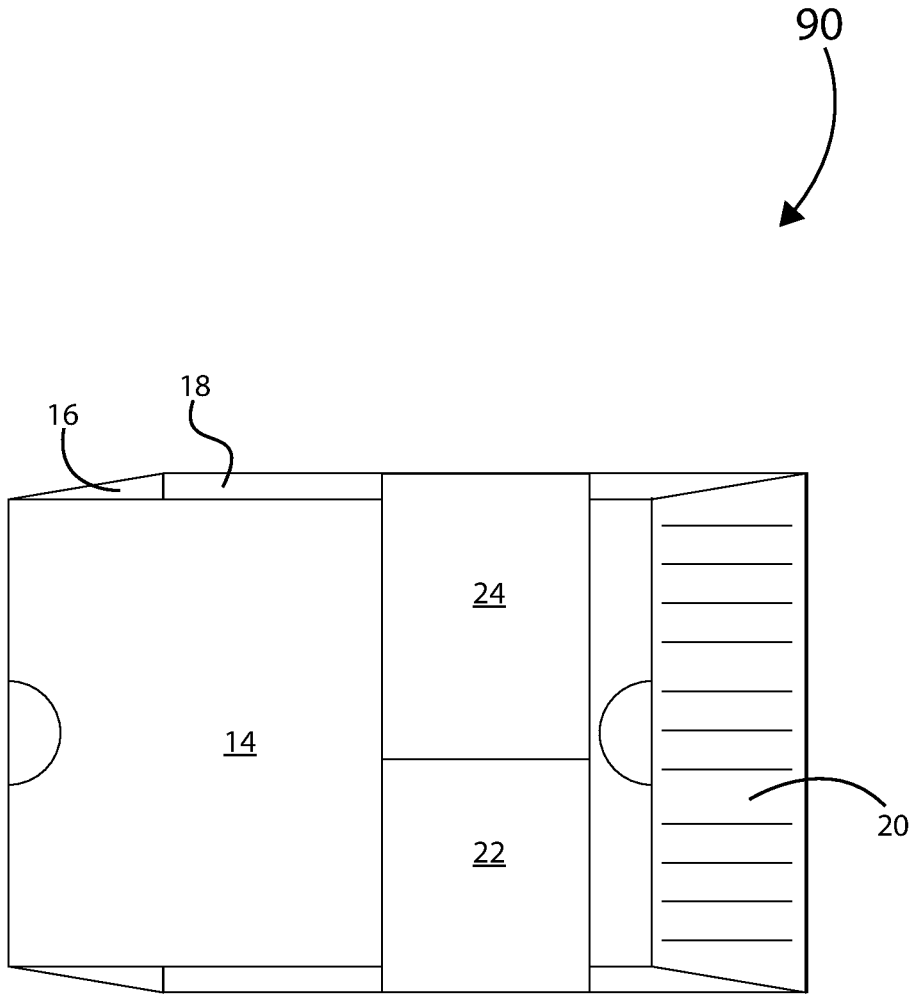
FIG. 6 shows a top view of the tray of FIG. 2 in a first, substantially flat configuration.

Blank 10 is positioned with its interior surface 6 facing up. Top panel 18 is rotated inwardly about fold line 13, bringing the interior surface 6 of top panel 18 into face-contacting relationship with the interior surface 6 of bottom panel 18 and first side panel 16, and the interior surface 6 of glue flap panel 12 into face-contacting relationship with the interior surface 6 of bottom panel 18. Glue G is applied to the exterior surface 8 of glue flap panel 12. Second side panel 20 is folded inwardly about fold line 17, bringing the interior surface 6 of second side panel 20 into face-contacting relationship with the exterior surface 8 of glue flap panel 12 and secured thereto. First locking arm flap 22 is folded inwardly about fold line 19, bringing the interior surface 6 of first locking arm flap 22 into face-contacting relationship with the exterior surface of top panel 14. Glue G is applied to the exterior surface 8 of the outermost portion 23 of first-locking arm flap 22. Second locking arm flap 24 is folded inwardly about fold line 21, bringing the interior surface 6 of the outermost portion of second locking arm flap 24 into contact with the exterior surface 8 of outermost portion 23 and securing it thereto. This results in the collapsed tray 90 shown in FIG. 6. First and second locking arm flaps 22, 24 together form a locking band 36 that maintains an underlying portion of top panel 14 in face-contacting relationship with bottom panel 18. In this configuration, the collapsed tray is substantially flattened as shown so that it can be transported or shipped in a compact form for erection and use elsewhere.

To erect the tray 90 for use, a user slides top panel 14 relative to bottom panel 18 until the top panel 14 is substantially aligned with bottom panel 18, locking band 30 is substantially aligned with and overlies a central portion of top panel 14, and first and second side panels 16, 20 are in a relatively perpendicular, but slightly inwardly-angled, relationship with respect to bottom panel 18. This results in the erected tray 90 shown in FIGS. 2-4. Finger cutouts can be used to facilitate grasping the top panel 14 and/or bottom panel 18 when sliding them relative to one another to erect the tray 90. The pressure applied by locking band 30 causes top panel 14 to form a concave curve as shown. This pressure may also cause bottom panel 18 to bow slightly prior to loading tray 90 with an item 40. Preferably however, bottom panel 18 is configured to resist such bowing as a result of its greater width W2 and the use of creases 30.

Figure 7:
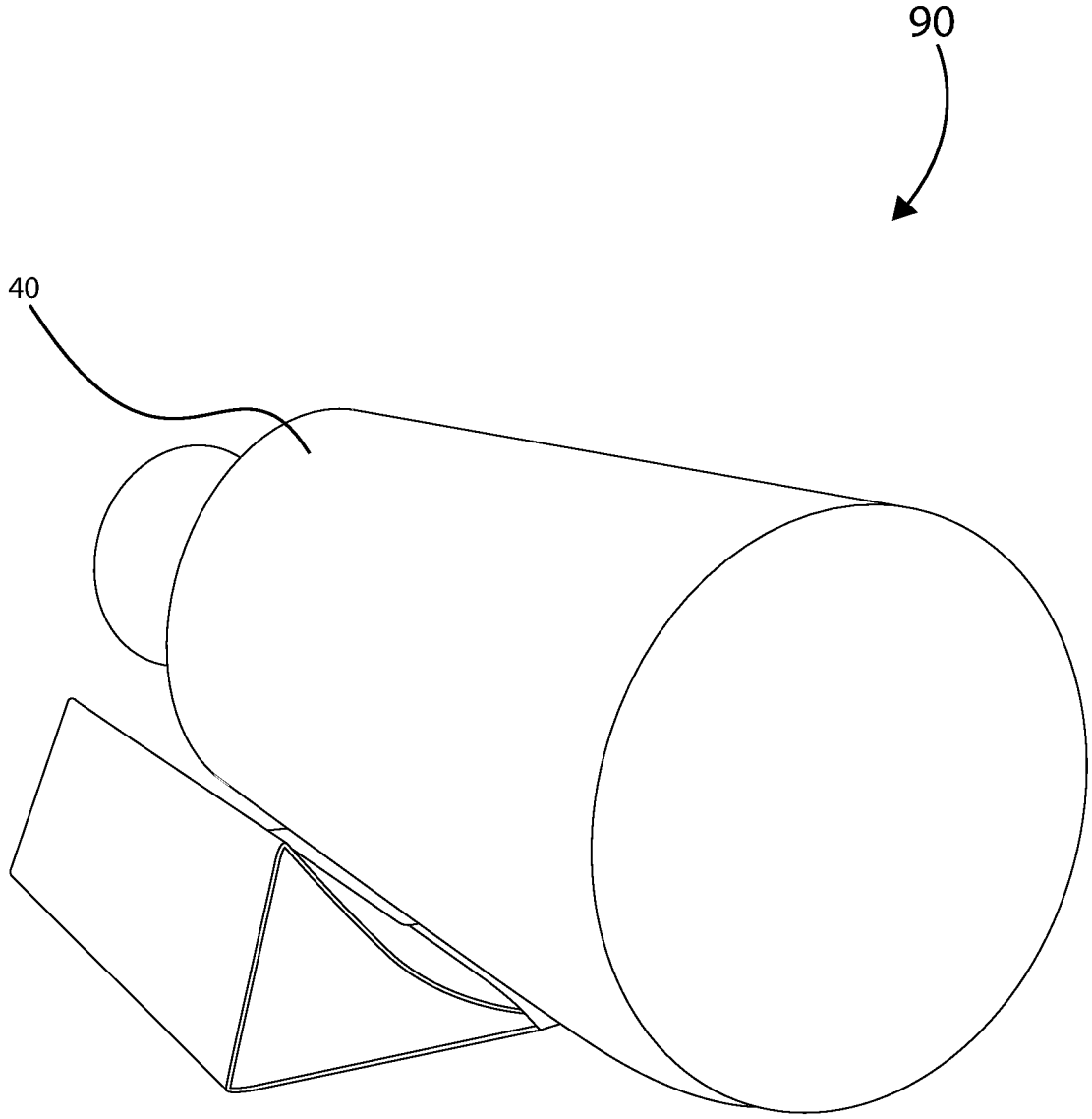
FIG. 7 shows a perspective view of the tray of FIG. 2 being used to hold an item.
Figure 8:
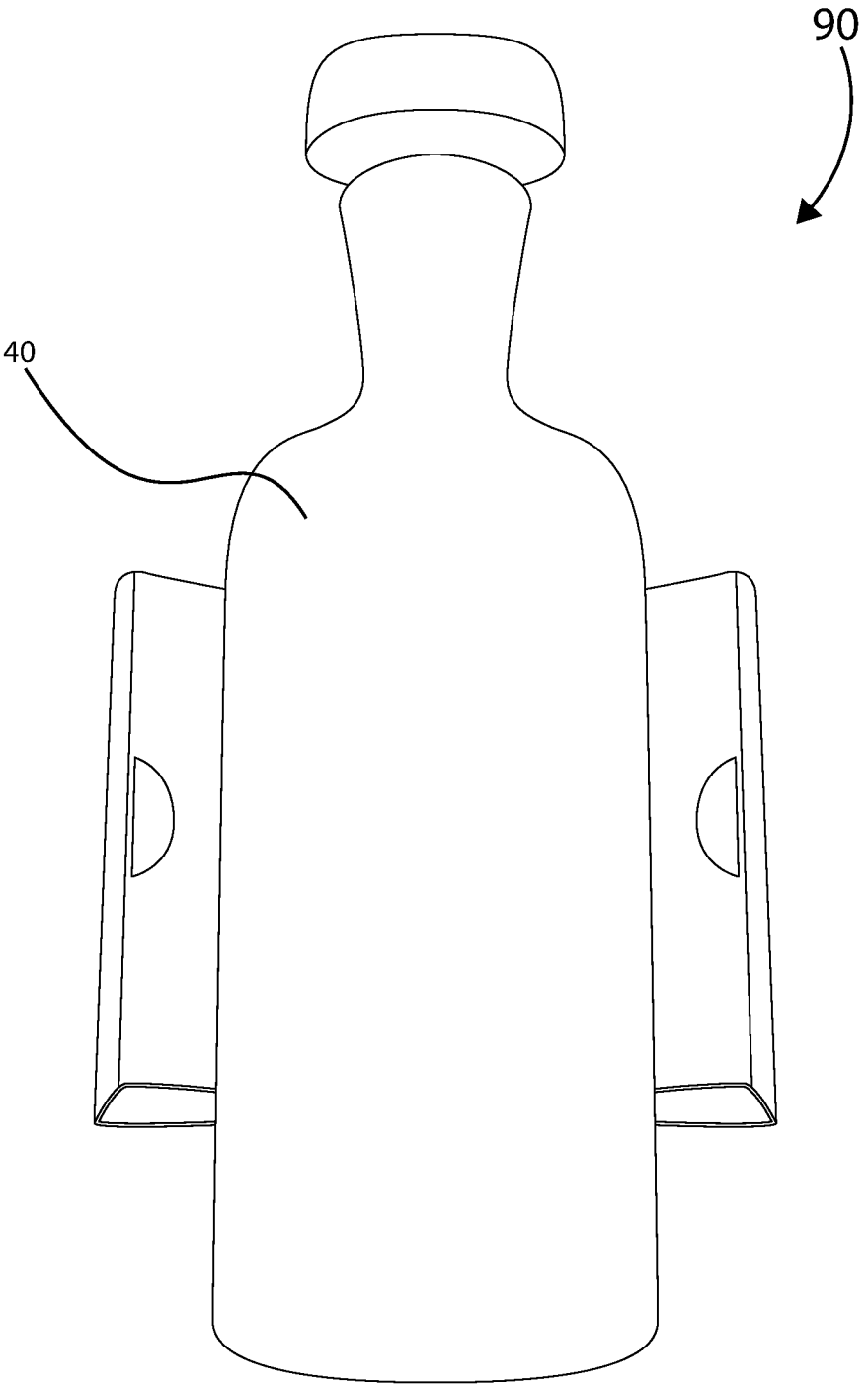
FIG. 8 shows a top view of the tray and item of FIG. 7.
Figure 9:
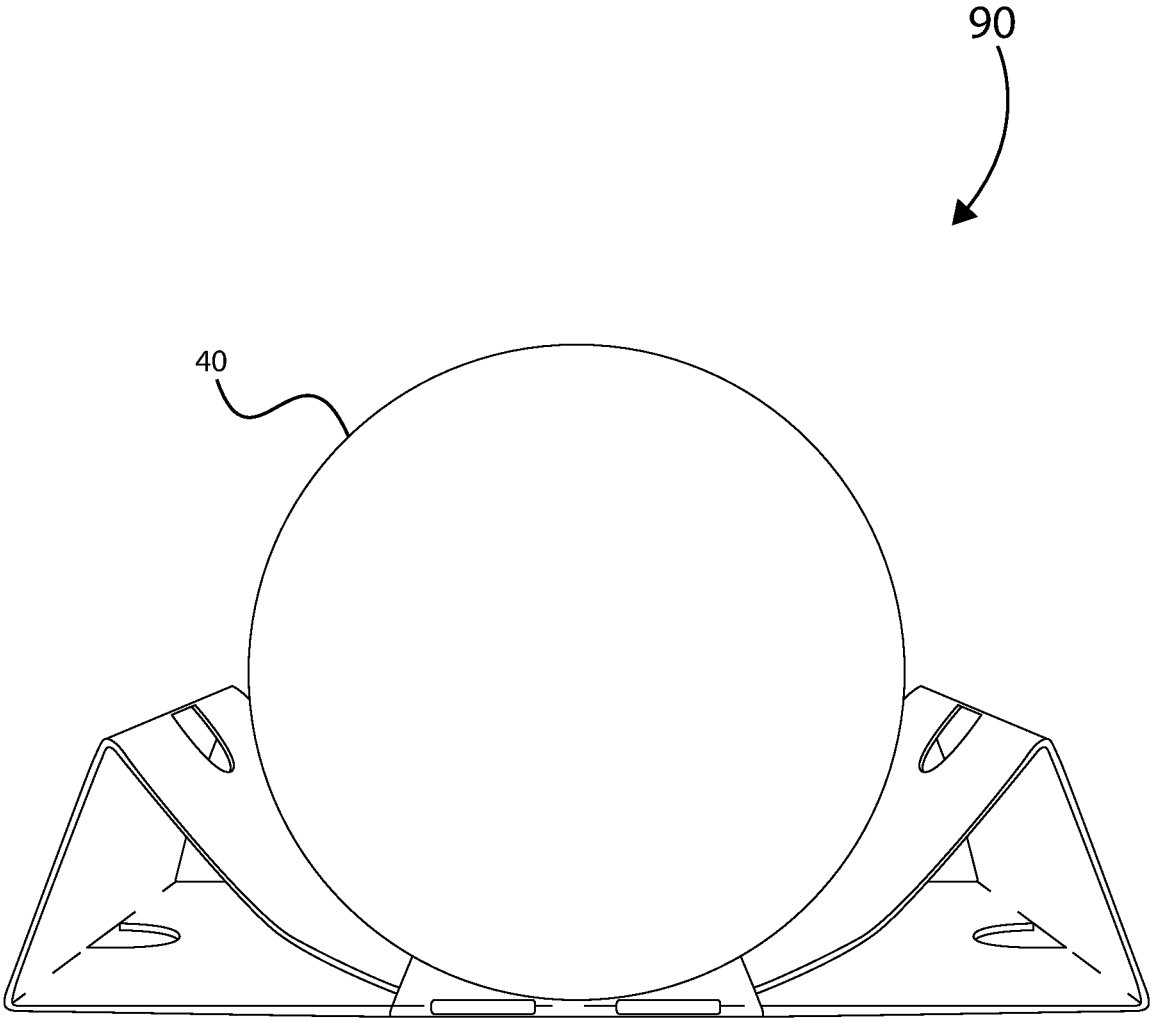
FIG. 9 shows an end view of the tray and item of FIG. 7.

As shown in FIGS. 7-9, a cylindrical or rounded item 40 may be loaded onto the erected tray 90 to hold the item 40 in place temporarily as, e.g., the item 40 moves along a production line. The weight of the item 40 will tend to further flatten bottom panel 18 into a substantially planar configuration while increasing the bowing of top panel 14. The bowing/concave shape of top panel 14 form rounded side walls that help hold the item 40 in place. Item 40 is preferably loaded onto tray 90 with its longitudinal axis substantially aligned with locking band 36 such that the rounded outer surface of item 40 is substantially aligned with or parallel to the rounded surface of top panel 14.

The configuration of the disclosed blank 10 and tray 90 may provide certain advantages. In particular, the blank 10 is simple and inexpensive to manufacture. Tray 90 may be shipped in a compact, flattened configuration and quickly and easily erected on site to accommodate and securely hold in place a variety of items of different sizes, shapes, and weights.

Figure 10:
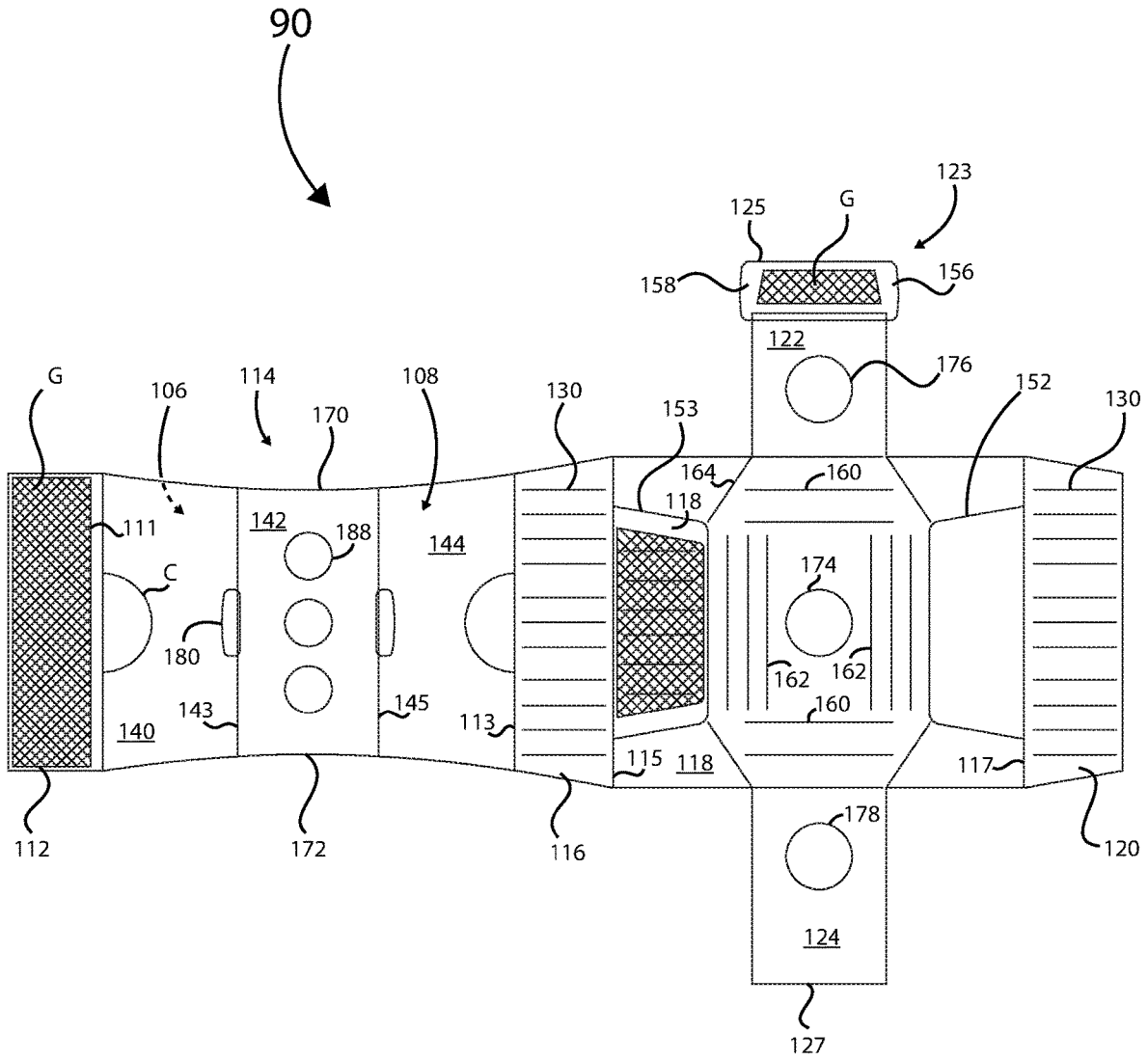
FIG. 10 is a top plan view of an exemplary blank of sheet material according to a second embodiment of the invention.
Figure 11:
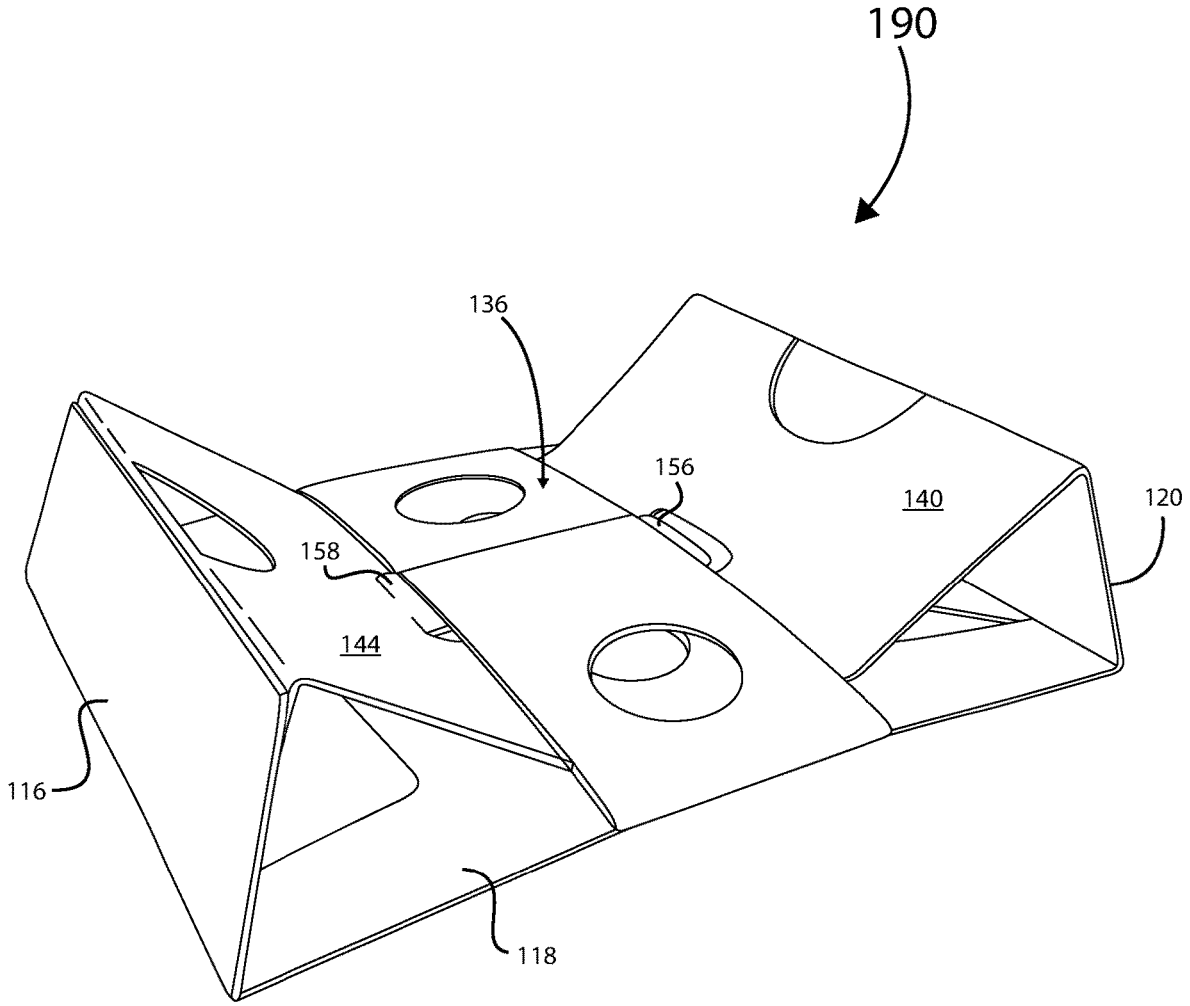
FIG. 11 is a perspective view of a tray formed from the blank shown in FIG. 10.
Figure 12:
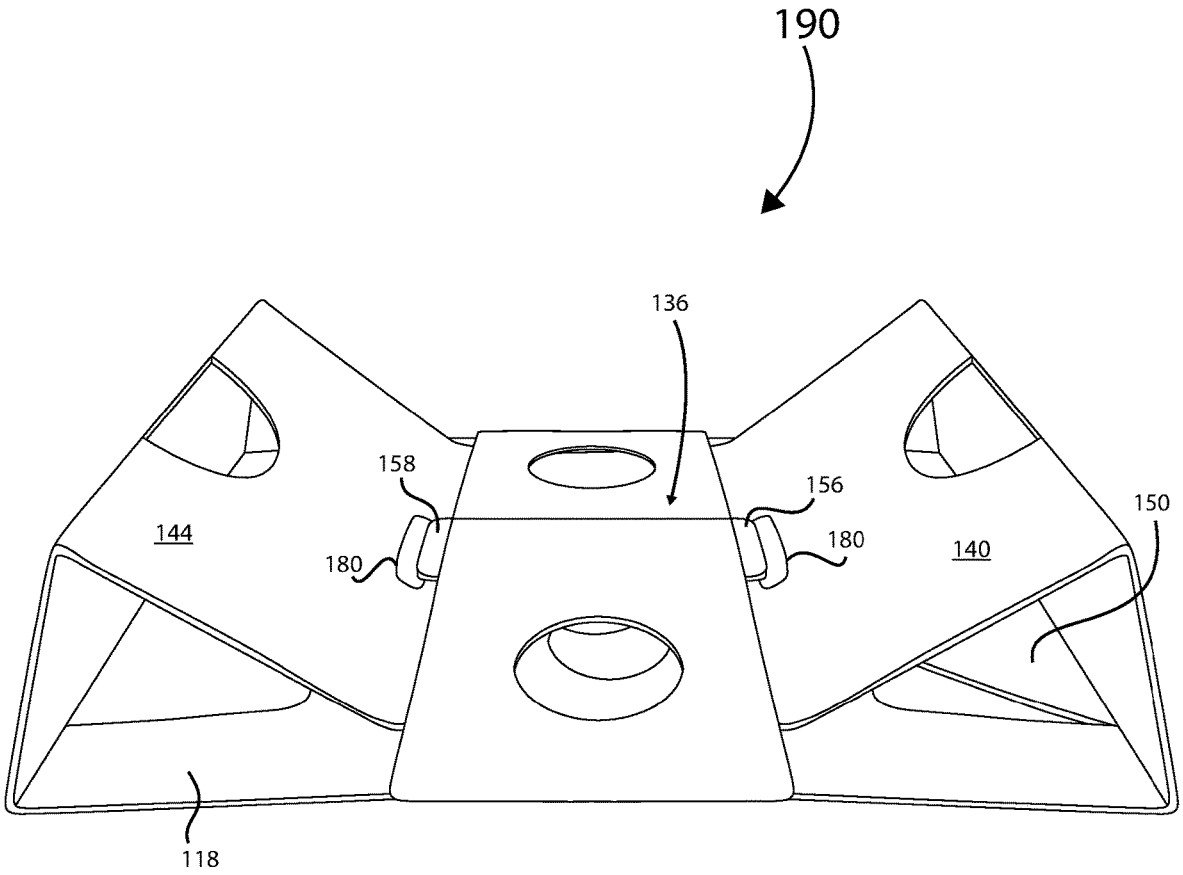
FIG. 12 is a second perspective view of the tray of FIG. 11.
Figure 13:
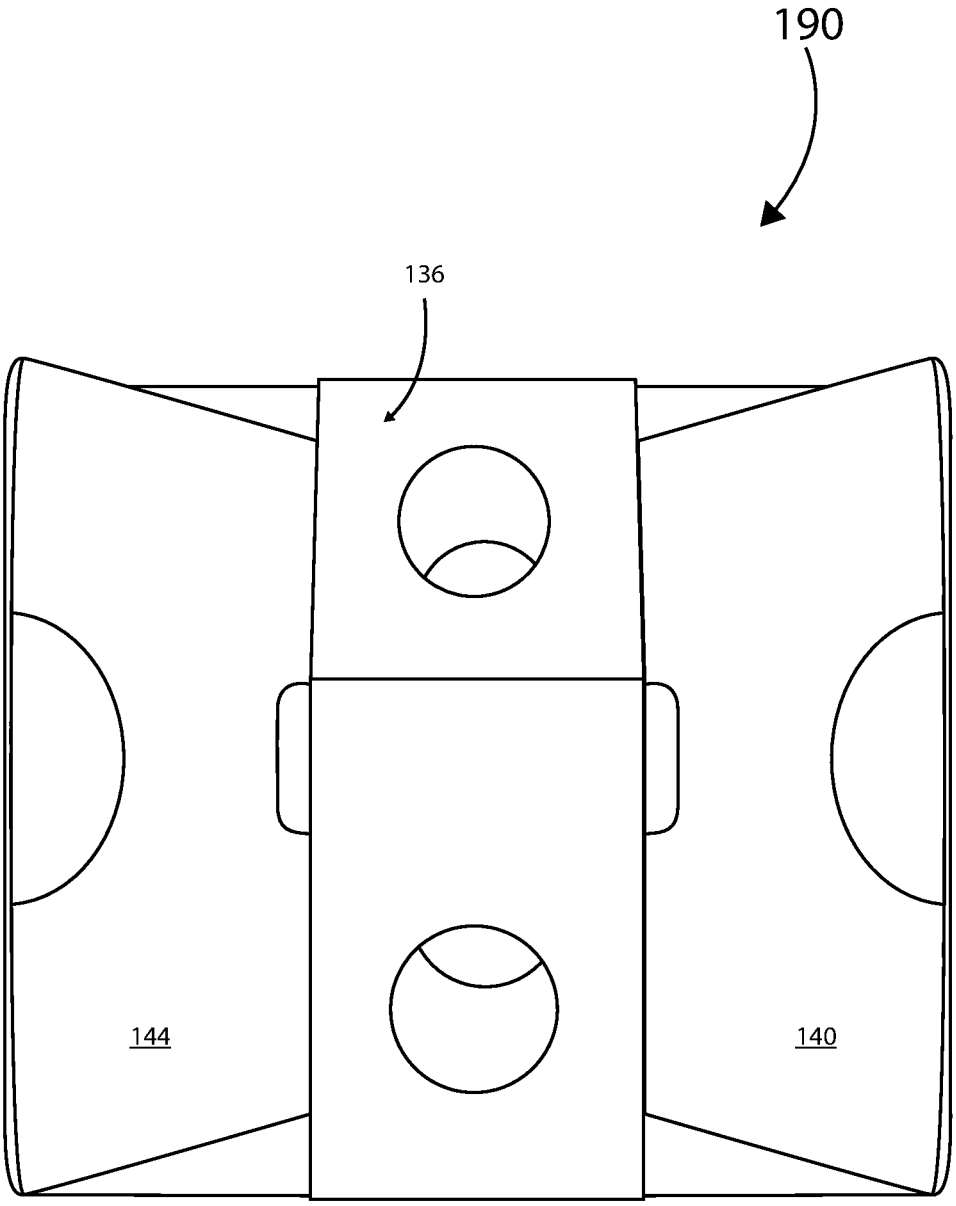
FIG. 13 is a top view of the tray of FIG. 11.
Figure 14:
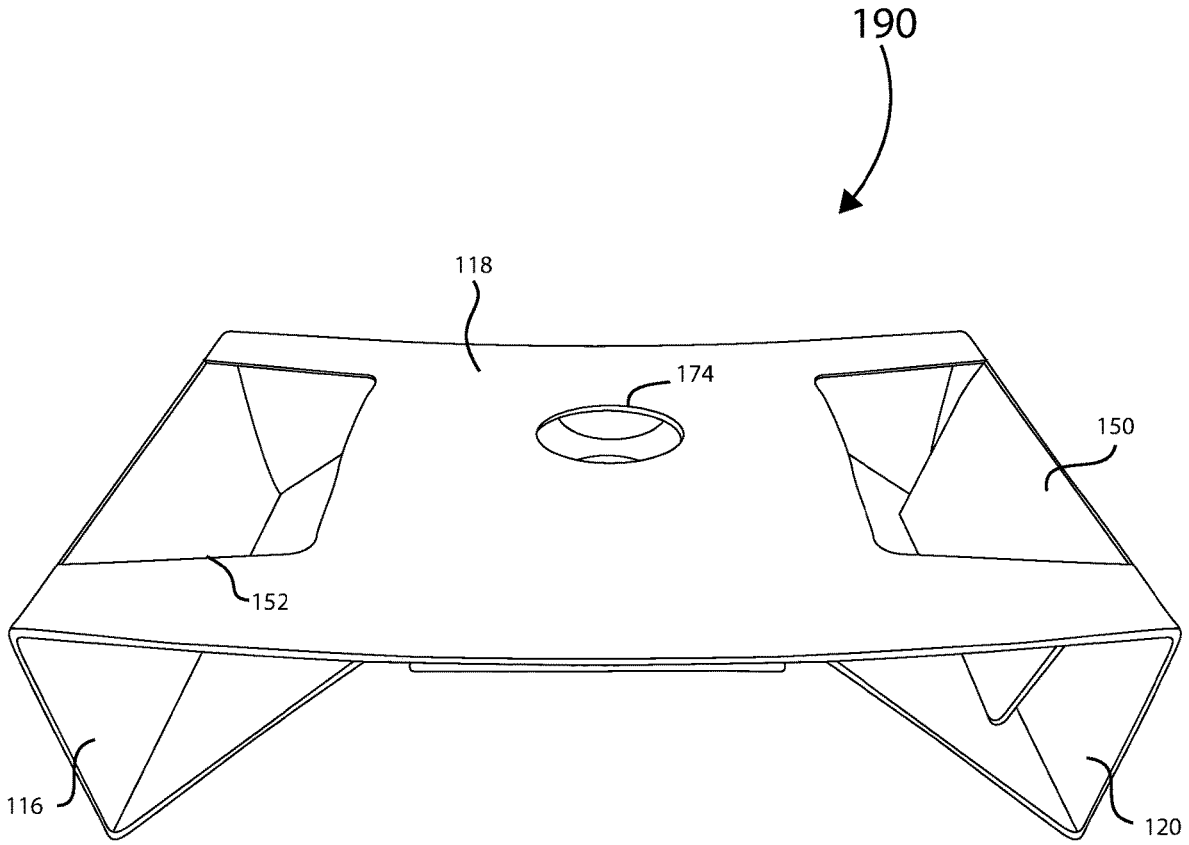
FIG. 14 is a bottom view of the tray of FIG. 11.

Referring to FIG. 10 there is shown a second embodiment of a tray blank 110 that forms a second embodiment of a tray 190 (shown in FIGS. 11-14). Blank 110 and the corresponding tray 190 can be generally similar to the blank 10 and tray 90 discussed above, and like or similar reference numbers in the figures indicate like or similar elements. Top panel 114, which forms a concave top wall 194 in set-up trap 190, is formed from three panels hingedly connected together in series: first top side panel 140, top center panel 142, and second top side panel 144. Top center panel 142 is hingedly connected to first top side panel 140 via transverse fold line 143, and to second top side panel 144 via transverse fold line 145. Upper and lower edges 170, 172 of top panel 114 can be slightly concave as shown.

A first locking aperture 180 is formed in first top side panel 140 along fold line 143, and a second locking aperture 182 is formed in second top side panel 144 along fold line 145. In the illustrated embodiment, locking apertures 180, 182 are generally rectangular in shape although other shapes can be used. First and second locking tabs 156, 158 project from opposite sides of outermost portion 123 of first locking arm flap 122. Locking tabs 156, 158 and locking apertures 180, 182 are configured so as to resist unintentional collapsing of the tray 190 when in the set-up condition. When the tray 190 is in the set-up condition, the first locking tab 156 will tend to catch in the first locking aperture 180 if the top panel 114 is moved too far in a first direction relative to bottom panel 118, thereby arresting further movement in that direction and maintaining the tray 190 in the set-up condition. Similarly, the second locking tab 158 will tend to catch in the second locking aperture 182 if the top panel 114 is moved too far in a second direction relative to bottom panel 118, thereby arresting further movement in that direction and maintaining the tray 190 in the set-up condition.

A reinforcing flap 150 is formed in the bottom panel 118 along fold line 115 via cutline 153. During assembly of tray 190, reinforcing flap 150 is folded into face-contacting relationship with, and adhesively secured to, first side panel 116 so as to form a double-thickness first side wall to match the double-thickness of the second side wall created by the overlapping of glue panel 112 and second side panel 120. A cutout 152 is formed in the bottom panel 118 along fold line 117 to mirror the opening created by reinforcing flap 150 when it is folded out of plane with respect to bottom panel 118.

A plurality of parallel creases and/or engraved lines 130 running perpendicular to the grain of the blank 110 may be formed in the first and second side walls 116, 120. Similarly a plurality of parallel creases and/or engraved lines 160 running perpendicular to the grain of the blank 110 may be formed in bottom panel 118, as well as a plurality of parallel creases and/or engraved lines 162 running parallel to the grain, and a plurality of angled creases 164. Creases 130, 160, 162, 164 may provide better strength and prevent unwanted creasing under load.

Top center panel 142 includes a plurality of cutouts 180. First locking arm flap 122 includes a cutout 176. Second locking arm flap 142 includes a cutout 178. Bottom panel 174 includes a central cutout 174. In the illustrated second embodiment, cutouts 180, 176, 178, and 174 are circular in shape although other shapes may be used. Cutouts 180, 176, 178, and 174 can be provided to reduce the weight of the blank 110 and the amount of blank material used.

Exemplary embodiments of blanks, trays, and methods of forming trays are described above in detail. The apparatus and methods are not limited to the specific embodiments described herein, but rather, components of apparatus and/or steps of the methods may be utilized independently and separately from other components and/or steps described herein. For example, in alternative embodiments, the locking arm flaps may be secured to one another to form the locking band via mechanical interconnection rather than, or in addition to, being secured together via adhesive.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A tray formed from a blank of sheet material, the tray comprising:

a bottom panel forming a bottom wall of the tray;

a top panel forming a top wall of the tray;

first and second side panels forming first and second side walls of the tray and extending between said top and bottom panels on opposite sides thereof;

a locking band connected to said bottom panel at opposite edges thereof, said locking band extending across said top panel from one free edge to an opposite free edge thereof and disposed in at least partial face-contacting relationship with said top panel; wherein said tray is configured to transition from a first configuration in which said tray is substantially flat into a second or erect configuration in which said top panel defines a concave surface configured to receive a rounded item; wherein said tray is configured to be transitioned from said first configuration to said second configuration by sliding said top panel relative to said bottom panel.

2. The tray according to claim 1, wherein the locking band overlies a generally central portion of the top panel when the tray is in the second configuration.

3. The tray according to claim 1 wherein said top panel has a first width and said bottom panel has a second width, and wherein said first width is smaller than said second width.

4. The tray according to claim 1, wherein at least one finger cutout is formed in said top panel.

5. The tray according to claim 4, wherein said at least one finger cutout comprises a first finger cutout formed along a first side edge of said top panel and a second finger cutout formed along a second opposite side edge of said top panel.

6. The tray according to claim 1, wherein a plurality of strengthening creases are formed in the first and second side panels.

7. The tray according to claim 1, wherein the top panel comprises a top center panel hingedly connected to a first top side panel and a second top side panel.

8. The tray according to claim 7, wherein said locking band comprises first and second locking tabs configured to be received within respective first and second locking apertures formed in the top panel so as to resist collapsing of the tray when the tray is in the second configuration.

9. The tray according to claim 1 wherein the top panel is disposed in face-contacting relationship with at least one of the first and second side panels when the tray is in the first configuration.

10. The tray according to claim 1, wherein said locking band is formed from overlapping first and second locking arm flaps, wherein said first locking arm flap is hingedly connected one of the opposite edges of said bottom panel, and wherein said second locking arm flap is hingedly connected to the other of the opposite edges of said bottom panel.

11. A tray formed from a blank of sheet material, the tray comprising:

a bottom panel forming a bottom wall of the tray;

a top panel forming a top wall of the tray;

first and second side panels forming first and second side walls of the tray and extending between said top and bottom panels on opposite sides thereof;

a locking band connected to said bottom panel at opposite upper and lower edges thereof, said locking band extending across said top panel and holding an underlying portion of said top panel in face-contacting relationship with said bottom panel;

wherein said tray is configured to transition from a first configuration in which said tray is substantially flat into a second or erect configuration in which said top panel defines a concave surface configured to hold in place a rounded item;

wherein said tray is configured to be transitioned from said configuration to said second configuration by sliding said top pane relative to said bottom panel, wherein said locking band is formed from overlapping first and second locking arm flaps, wherein said first locking arm flap is hingedly connected to the upper edge of said bottom panel, and wherein said second locking arm flap is hingedly connected to the lower edge of said bottom panel.

12. A blank of sheet material for forming a tray, the blank comprising:

a plurality of panels hingedly connected in series, the plurality of panels comprising a top panel configured to form a top wall in a set-up tray, a first side panel configured to form a first side wall in the set-up tray, a bottom panel configured to form a bottom wall in the set-up tray, and a second side panel configured to form a second side wall in the set-up tray;

a first locking arm flap hingedly connected to the bottom panel along an upper edge thereof and a second locking arm flap hingedly connected to the bottom panel along a lower edge thereof;

wherein the first and second locking arm flaps are configured to be secured together to form a locking band in the set-up tray, the locking band extending across said top panel and holding an underlying portion of said top panel in face-contacting relationship with said bottom panel.

13. The blank according to claim 12, wherein said plurality of panels comprises a glue flap panel configured to be secured in face-contacting relationship to the second side panel in the set-up tray.

14. The blank according to claim 12, wherein said top panel has a first width and said bottom panel has a second width, and wherein said first width is smaller than said second width.

15. The blank according to claim 12, wherein at least one finger cutout is formed in said top panel.

16. The blank according to claim 15, wherein said at least one finger cutout comprises a first finger cutout formed along a first side edge of said top panel and a second finger cutout formed along a second opposite side edge of said top panel.

17. The blank according to claim 12, wherein a plurality of strengthening creases are formed in the first and second side panels.

18. The blank according to claim 12, wherein the top panel comprises a top center panel hingedly connected to a first top side panel and a second top side panel.

19. The blank according to claim 12, wherein said locking band comprises first and second locking tabs configured to be received within respective first and second locking apertures formed in the top panel so as to resist collapsing of the set-up tray.

20. The blank according to claim 12, wherein the first and second locking arm flaps are configured to be overlapping with each other to form said locking band which is configured to extend across said top panel from one free edge of the top panel that corresponds to the upper edge of the bottom panel to an opposite free edge of the top panel that corresponds to the lower edge of the bottom panel in the set-up tray, and wherein said locking band is configured to be disposed in at least partial face-contacting relationship with said top panel in the set-up tray.

* * * * *